United States Patent [19]

Persiani et al.

[11] Patent Number: 4,736,136

[45] Date of Patent: Apr. 5, 1988

[54] DISCHARGE LAMPS WITH COATED CERAMIC ARC TUBES AND FABRICATION THEREOF

[75] Inventors: Carmine Persiani, Medford, N.Y.; Alfred E. Feuersanger; Frank C. Palilla, both of Framingham, Mass.

[73] Assignee: GTE Laboratories Incorporated, Waltham, Mass.

[21] Appl. No.: 874,972

[22] Filed: Jun. 16, 1986

[51] Int. Cl.[4] ..... H01J 9/24; H01J 61/35

[52] U.S. Cl. ..... 313/635; 313/636; 427/126.4; 445/58

[58] Field of Search ..... 313/635, 25, 634, 636; 445/26, 58; 427/106, 126.2, 126.4, 126.3, 126.6

[56] References Cited

U.S. PATENT DOCUMENTS

| | | | |
|---|---|---|---|
| 2,238,777 | 4/1937 | Lemmers et al. | 313/635 X |
| 3,377,498 | 4/1968 | Koury et al. | 313/321 |
| 3,825,792 | 7/1974 | Rokosz et al. | 313/487 |
| 3,842,306 | 10/1974 | Henderson et al. | 313/116 |
| 3,845,343 | 10/1974 | Hammer | 313/221 |
| 4,047,067 | 9/1977 | Clausen | 313/635 X |
| 4,058,639 | 11/1977 | Schreurs | 427/67 |
| 4,079,288 | 3/1978 | Maloney et al. | 313/489 |
| 4,264,541 | 4/1981 | Oda et al. | 264/62 |
| 4,289,991 | 9/1981 | Schreurs | 313/489 |
| 4,435,669 | 3/1984 | Plagge et al. | 313/635 X |

OTHER PUBLICATIONS

Yuldas and Partlow "Formation of Continuous Beta Alumina Films and Coatings at Low Temperatures", Ceramic Bulletin, vol. 59, No. 6 (1980), pp. 640–642.

*Primary Examiner*—David K. Moore
*Assistant Examiner*—K. Wieder
*Attorney, Agent, or Firm*—Ivan L. Ericson

[57] ABSTRACT

A high pressure sodium lamp brightness was increased 8.9%, its relative voltage stability was improved by a factor of 4, and its relative maintenance was improved by a factor of 3 over a 24,000 hour lifetest. These improvements were accomplished by the application of a fine grained alumina protctive coating on the surface of the polycrystalline alumina arc tube. The process for applying the protective coating comprises the deposition of $Al(NO_3)_3$ from solution on the surface of the arc tube followed by the thermal decomposition of the $Al(NO_3)_3$ to form an alumina coating on the surface of the alumina arc tube.

7 Claims, 3 Drawing Sheets

DISCHARGE LAMPS WITH COATED CERAMIC ARC TUBES AND FABRICATION THEREOF

FIELD OF THE INVENTION

This invention relates to ceramic arc tubes for high pressure sodium lamps, lamps made therefrom and fabrication thereof.

More particularly, this invention relates to coated ceramic arc tubes for high pressure sodium lamps, lamps made therefrom and fabrication thereof.

BACKGROUND OF THE INVENTION

The acceptance of high pressure sodium lamps is steadily increasing since their introduction in 1966. This type of light source is more efficient than incandescent, fluorescent, or mercury lamps, and shows considerably improved color rendition over low pressure sodium lamps. Due to the current emphasis on conservation of energy, a continued growth of the market for HPS lamps is expected for adequate illumination in industrial, public, commercial, and now even in consumer applications with reduced energy consumption.

The main part of the high pressure sodium HPS lamp is the ceramic arc tube, usually fabricated from high density polycrystalline alumina, which contains the gas discharge. In addition, high light transmission is required to transmit the visible energy produced by the discharge. With the lamp operating at high temperatures and high pressures and containing a sodium amalgam fill only a few materials are suitable to contain the sodium. Even by the use of ceramics such as polycrystalline aluminum (PCA), small amounts of sodium escape from the arc tube by diffusion through the polycrystalline wall structure and are deposited on the wall of the evacuated outer jacket of the lamp, causing reduced transmission of the glass and decreased light output with time. Due to the statistical nature of grain growth, small grain-boundary defects do occur, which can be an additional route for sodium loss from the arc tube.

Chemical analysis of the inner wall of HPS lamp jackets confirmed the presence of a high sodium content. Therefore, it would be desirous to prevent sodium migration into and through the polycrystalline arc tube wall.

OBJECTS OF THE INVENTION

It is object of this invention to provide an improved high pressure sodium arc tube and a lamp made therefrom.

It is a further object of the invention to provide an improved method of applying a protective coating on a polycrystalline ceramic arc tube envelope for a high pressure sodium arc tube.

SUMMARY OF THE INVENTION

These and still further objects, features and advantages of the invention are achieved, in accordance therewith, by providing a new and improved high pressure sodium arc tube which comprises a polycrystalline ceramic arc tube envelope, end closures, electrodes, electrical connectors, and an arc tube fill. The polycrystalline ceramic arc tube envelope has a protective oxide coating concentrated at the grain boundaries on the surface of the envelope to retard sodium migration through the envelope wall.

In accordance with another aspect of the present invention a method of applying a protective oxide coating on the surface of a polycrystalline ceramic arc tube envelope concentrated at the surface grain boundaries of the envelope to retard sodium migration through the envelope wall comprises the following steps:

Step 1. An aqueous nitrate solution of a metal corresponding to the cation of the polycrystalline ceramic arc tube envelope is applied to the surface of the envelope to form an envelope coated with an aqueous nitrate solution.

Step 2. The aqueous nitrate solution coated on the surface of the envelope is dried to form a nitrate coating on the surface of the envelope.

Step 3. The nitrate coating on the surface of the envelope is converted to an oxide to form a protective oxide coating concentrated at the surface grain boundaries of the polycrystalline ceramic arc tube envelope.

For a better understanding of the present invention, together with other and further objects, advantages and capabilities thereof, reference is made to the following disclosure and appended claims in connection with the above-described drawings.

DETAILED DESCRIPTION OF THE PREFERRED EMBODIMENTS

Figure 1:
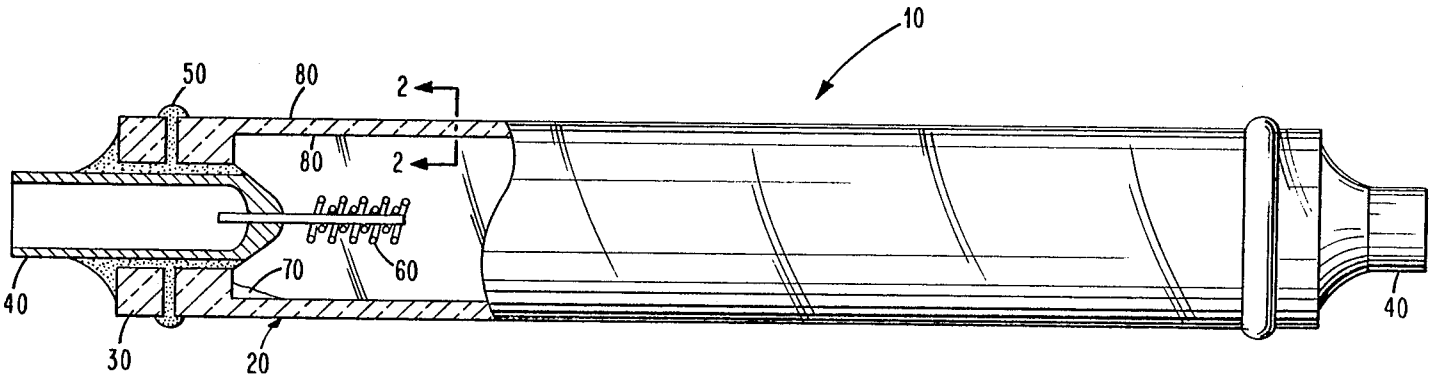
FIG. 1 is a view, partially in section, of a high pressure sodium arc tube in accordance with the present invention.
Figure 3:
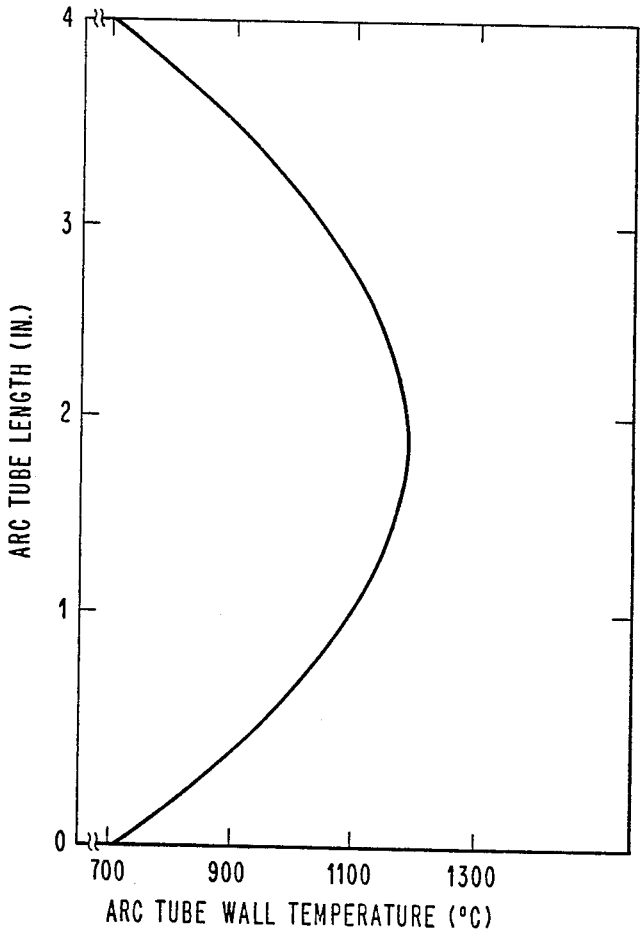
FIG. 3 is a curve of the wall temperature of a high pressure sodium arc tube as a function of the arc tube length.

A high pressure sodium arc tube 10 is shown in FIG. 1, embodying the invention and comprising an arc tube envelope 20 of ceramic tubing consisting of sintered high density polycrystalline alumina (PCA). The ceramic is not clear like quartz, but has a very high light transmittance of 95% or better that is very suitable as a plasma discharge vessel. The high pressure sodium arc tube 10 is hermetically sealed at both ends. An electrode assembly comprising an end closure (sealing button 30) containing a niobium feedthrough 40, a high temperature calcium aluminate based sealing frit 50, and a thermionic electrode 60 is sealed to the end of the arc tube by heating the arc tube sufficiently to melt the high temperature calcium aluminate-based sealing frit 50. Thermionic electrodes 60 are tungsten impregnated with an oxide emissive coating. The arc tube fill 70, mercury-sodium amalgam, is placed in the arc tube 10 before it is hermetically sealed at the second end in an appropriate fill gas, e.g. Xenon. The wall temperature along the wall of arc tube envelope 20 in axial direction is shown in FIG. 3 for an HPS lamp operating in equilibrium at rated power. The cold spot or temperature at the end of the arc tube is in the range of 680° C. to 720° C. for regular HPS lamps and approx. 800° C. for lamps with high color rendering index. This temperature determines the partial vapor pressures of the fill components in the discharge vessel during operation. The partial sodium pressure is related and derived from the shape and difference in wavelength $\Delta\lambda$ between the two maxima of the self-reversed sodium resonance line. For optimum light output the separation of the self-reversed Na D-lines is about 8.5 nm. The gas pressures in the operating lamp are: for Na, 60 to 150 torr (8 to 20 kPa) with an optimum value of 105 torr; for Hg, 400 to 800 torr (53 to 106 kPa); and for Xe, about 20 torr (2.67 kPa). The buffer gas xenon (Xe), with increasing pressure, increases the thermal isolation of the arc discharge from the arc tube wall, improves the spectral light intensity distribution of the lamp and its luminous efficacy. However, it also contributes to higher ignition voltages for the discharge and is, therefore, usually limited to 100 torr (13.3 kPa).

Figure 2:
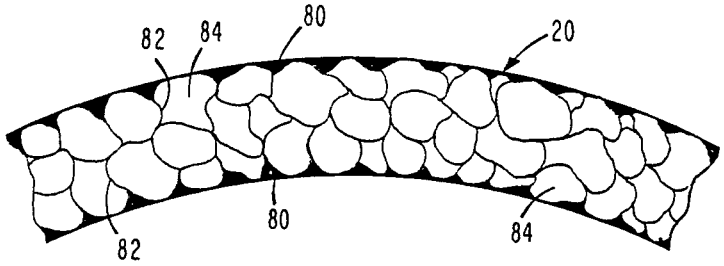
FIG. 2 is an illustrative cross sectional view along line 2—2 of FIG. 1.

In FIG. 2, the fine grain alumina coating 80 on the surface of the polycrystalline alumina (PCA) arc tube envelope 20 is depicted. The PCA arc tube envelope 20 has grains 84 with a crystallite size of approximately 33 microns in diameter on the average. For larger crystallite sizes, transmission is higher as a rule due to reduced scattering and absorption in the smaller grain boundary volume. The fine grain alumina coating 80 produced on the PCA arc tube envelope 20 is approximately 1 micron thick, with crystallite sizes in the range from about 0.5 to 1 micron. Alumina, a strongly anisotropic material, has to be prepared with a fine grain size to reduce internal strains and to optimize the strength and transmission of the arc tube. The alumina coating of the arc tube seals the paths sodium can use thereby allowing the use of an arc tube envelope having a larger grain size. The overall thickness of the arc tube envelope wall is in the range from 0.02 to 0.03 inches, with the smaller thickness preferred to reduce light losses.

The fine grain alumina coating 80 as shown in FIG. 2 is highly transparent in the range of the visible spectrum and seals the grain boundaries 82 of the surface grains 84 to reduce migration of the sodium fill thereby increasing lamp life (maintenance).

The Arc Tube Coating Process

The following processing steps are used to produce high transmission coatings of $Al_2O_3$ on the PCA arc tube envelope.

1. Arc tube envelopes are degreased by placing them in a beaker containing methylene chloride for five minutes.

2. Arc tube envelopes are removed with tweezers, placed on a clean watch glass, and air dried.

3. After drying, the arc tube envelopes are soaked in a 15% aqueous solution of aluminum nitrate for five minutes.

4. The excess fluid is allowed to drain off, after which they are allowed to air dry at room temperature for thirty (30) minutes.

5. The air dried arc tube envelopes are then transferred to a laboratory oven where they are further dried at 115° C. for twenty (20) minutes.

6. The arc tube envelopes are placed in alumina boats and heated to 500° C. for two hours in a muffle furnace.

7. After heating has been completed, the envelopes are cooled in air, removed, and mounted for testing.

In addition, alumina arc tube envelopes were coated under the same conditions as described above with the additional step of adding two drops of a wetting agent to the aluminum nitrate solution prior to coating. The addition of alkyl phenoxy polyethoxyethanol (Triton, Trademark of Rohm and Haas) was found to improve the wetting of the arc tube envelopes by the aluminum nitrate solution.

The alumina arc tube envelopes were processed and dried and examined by scanning electron microscopy (SEM). Photomicrographs taken by SEM reveal a dispersion of the fine grain aluminum oxide coating 80 on the surface of the arc tube envelope 20 which is concentrated at the grain boundaries 82. Although the coating is not continuous there is evidence of coalescing and film formation along the grain boundaries.

It is the preferred coating of the grain boundaries that is expected to minimize sodium loss and thereby not degrade the transmission while improving lamp maintenance.

The coating process consists of a two-step process given by:

$$Al(NO_3)_3.9H_2O \xrightarrow[140^\circ C.]{-H_2O} Al(NO_3)_3 + 9H_2O$$

$$Al(NO_3)_3 \xrightarrow[\text{Air, } 500^\circ C.]{\text{HEAT}} Al_2O_3 + NO_x$$

Figure 4:
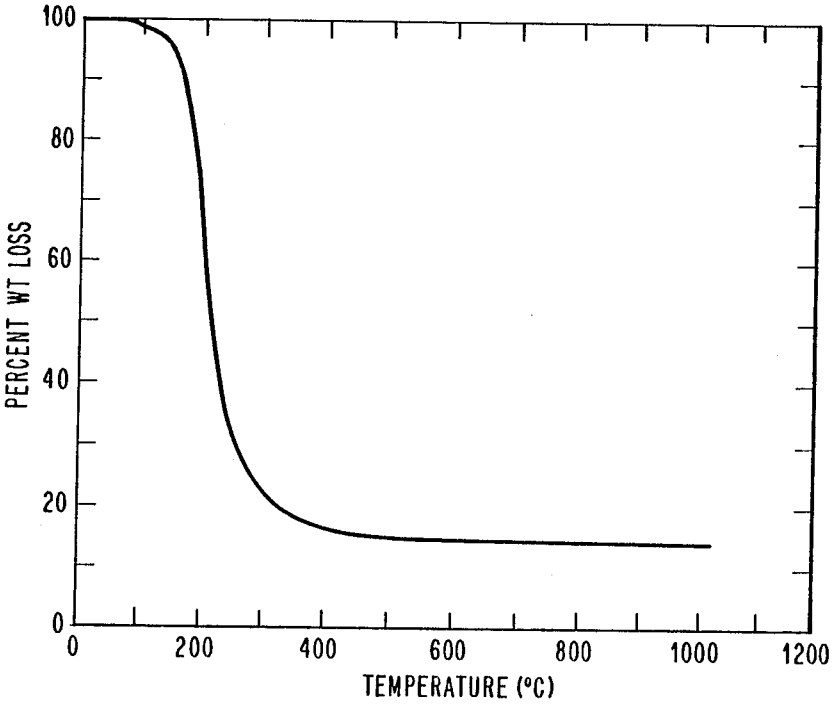
FIG. 4 is a TGA curve of $Al(NO_3)_3.9H_2O$.

The conversion of aluminum nitrate into aluminum oxide, as described by the chemical reaction equations (1) and (2), has been investigated analytically by thermogravimetric analysis. The results of this analysis are shown in FIG. 4. The initial loss of water is completed at about 130° C., and the conversion reaction is essentially completed at 500° C. The generation of $NO_x$ in the decomposition of the nitrate further enhances the formation of a fully oxidized alumina coating. This is important to obtain a coating with high optical transmission and a minimum of absorption.

The arc tube envelope is exposed to temperatures of about 1200° C. at the center, and from 700° to 750° C. (cold spot) at the ends of the tube during lamp operation. (See FIG. 3.) The stability of the light output of the coated lamp was monitored for more than 100 hours during integrating sphere operation and measurements. These measurements show that during lamp operation at higher temperatures, the coating on the arc tube envelope is not changed in its transmission properties.

Light Transmission of Ceramic Arc Tubes

Figure 5:
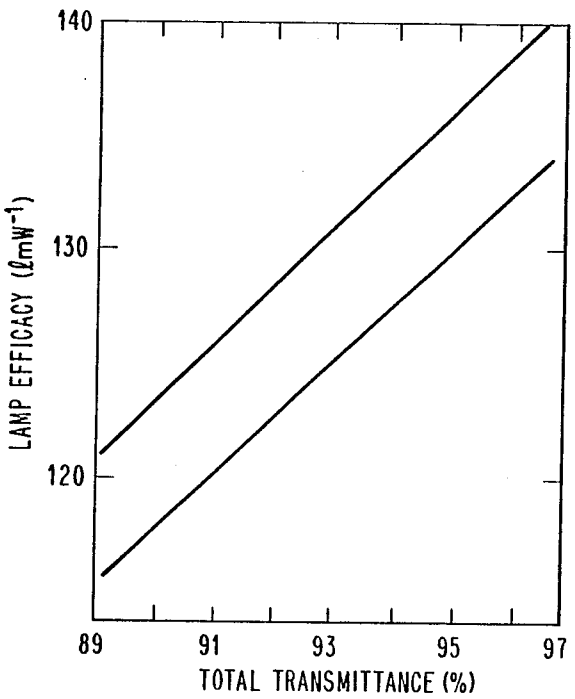
FIG. 5 is a curve of lamp efficacy as a function of total transmittance.

The achievement of high ceramic arc tube transmission values is important, since the lamp lumen output and therefore the lamp efficacy is directly proportional to arc tube transmission. This has been shown by M. Kaneo and I. Oda in "Effect of the Properties of Translucent Alumina on Lamp Efficiency of High Pressure Sodium Lamps," Proc. 4th Int. Meeting on Modern Ceramic Techn., ed. P. Vincenzini Elsevier Publishers, pp. 1114–1122, Amsterdam, The Netherlands (1980). The results of this work are shown in FIG. 5, which shows the range of experimental values published.

Photometric Measurements of Transmittances

The specular (in-line) and total diffuse transmittances of the experimental arc tubes were measured with a production/quality control test assembly obtained from the Hoffman Engineering Corporation, 183 Sound Beach Ave., P.O. Box 300, Old Greenwich, Conn. 06870 (model PTE-80-ST). The total transmittance is measured in an integrating sphere which collects the light transmitted through the arc tube positioned over an internal light source, the 100% setting is obtained without the arc tube centered over the light source. The "in-line" transmission utilizes a small area light source incident upon the arc tube, and a photometer placed beyond the arc tube is used to determine the relative degree of diffusion produced by the arc tube material. The indicated readings were obtained in this manner.

Results of Transmission Measurements

Transmission of selected arc tube envelopes used in lamp fabrication are as follows:

| | Arc Tube Envelope | | |
|---|---|---|---|
| Number | $T_{Total}$ (%) | $T_{in\text{-}line}$ (%) | Remarks |
| 1 | 96.37 ± 0.13 | 5.65 ± 0.04 | Before coating. |
| 3 | 96.45 ± 0.10 | 4.62 ± 0.02 | Before coating. |
| 9 | 96.32 ± 0.03 | 3.62 ± 0.04 | Before coating. |
| 1 | 96.91 ± 0.11 | 5.80 ± 0.09 | Coated and fired at 500° C. |
| 3 | 96.81 ± 0.01 | 4.64 1 0.04 | Uncoated control. |
| 9 | 94.07 ± 0.09 | 3.52 ± 0.04 | Coated and fired at 1000° C. |

Envelope 3 is the uncoated control and shows the reproducibility of the measurements. For firing at 1000° C. it was observed that the tubes have turned slightly orange, and the transmission is reduced by a small amount, 2.25%, in total transmission. This may still be acceptable for arc tubes envelopes that are sealed against sodium migration from the arc tube envelope (envelope #9).

Firing at 500° C. of the deposited $Al_2O_3$ layer shows a slight increase in transmission (envelope #1), giving additional improvements in light output over the control arc tube envelope (envelope #3).

Example of Lamp Fabrication

150 W, 100 V-type HPS arc tube envelopes were selected for fabricating the requisite lamps. The transmittance of the arc tube envelopes was determined and coatings were than prepared on the surfaces of the arc tube envelopes. Remeasurement of total transmittance and in-line transmission was not altered when the coating was applied by the process described.

The arc tube envelopes 20 are then processed into lamp arc tubes 10 by forming a ceramic frit seal 50 on one end of the tube envelope sealing in a niobium feedthrough tube 40 on which a tungsten electrode assembly 60 is attached. The tungsten cathode coil is impregnated with a barium-calcium-tungstate emissive coating ($Ba_2CaWO_6$) to reduce electrode losses with this low work function material. The lamp arc tubes are then filled with a 75–25% Hg-Na amalgam in a dry atmosphere, evacuated and backfilled with a xenon atmosphere to yield a 20 torr pressure in the lamp after the second electrode feedthrough seal is formed. The finished arc tubes are checked for leaks by operating a low pressure discharge excited with a Tesla coil to assure that the seals are formed properly. The arc tubes are then mounted on a lamp feedthrough stem and support frame, which is then encapsulated in the outer envelope. The envelope is heated and pumped out. After a vacuum pressure of less than $2\times10^{-6}$ torr is achieved, the stem tube is tipped off. The Ba-getters are flashed to absorb residual gases further and the lamp is then based.

Performance of Lamps

In this example, lamp 118–121 with a coated PCA arc tube, is compared with lamp 122–123 with an uncoated conventional arc tube serving as a control.

After ten hours of operation, the coated lamp 118–121 maintains a 15,050 lumen output, 8.74% higher than the regular uncoated lamp control 122–123. At 100 h testing in the integrating sphere, the $Al_2O_3$-coated lamp was 4% higher than the control.

These results show that the transmission of the $Al_2O_3$ coating formed at 500° C. is not changing by being heated to temperatures from 700° C. to 1200° C. when incorporated into a lamp; i.e., when the outside is exposed to a vacuum and the inside to Hg, Na, and Xe.

| Results From Life Tests Of The Coated And Uncoated Control Lamps. | |
|---|---|
| Lamp type: | 150 W, 100 V-HPS |
| Identification: | Lamp 118-121 has the $Al_2O_3$ coated arc tube<br>Lamp 122-123 is the control lamp with an uncoated arc tube. |

Individual S56 type ballasts were adjusted by means of adjusting the capacitor values that the lamps will operate at 150 W when line voltage is applied to the ballast with the particular lamp as a load. Lamp 118–121 is operating on ballast S-56-5 and lamp 122–123 on ballast S-56-6.

| | Lamp Operating Time | |
|---|---|---|
| Initial tests | Lamp 118-121 | Lamp 122-123 |
| Elapsed operating time | 105.1 hrs. | 201.5 hrs. |
| Prelim. life test | 48.8 hrs. | 50.4 hrs. |
| Continuous life test (992 days) | 23,808 hrs. | 23,808 hrs. |
| Total line | 23,961.9 hrs.<br>23,962 hrs. | 24,059.9 hrs.<br>24,060 hrs. |

The lamps were operated vertically on life test with a red opaque cylindrical shield and an aluminum top closure disc to simulate a fixture environment.

The lumen output was measured in a calibrated one meter integrating sphere.

| Results of Life Test Measurements | | | | | | | |
|---|---|---|---|---|---|---|---|
| $V_l$ = Lamp voltage, $I_1$ = Lamp current, $\phi_a$ = Luminous output, t = Operating time. | | | | | | | |
| $Al_2O_3$ Coated Lamp #118-121 | | | | Uncoated Control Lamp #122-123 | | | |
| t (hrs) | $V_1$ (Volt) | $I_1$ (Amp) | $\phi_a$ (klm) | t (hrs) | $V_1$ (Volt) | $I_1$ (Amp) | $\phi_a$ (klm) |
| 105.1 | 90.8 | 2.104 | 15.41 | 201.5 | 86.4 | 2.235 | 15.05 |
| 23,962 | 96.3 | 2.072 | 14.91 | 24,060 | 107.4 | 1.832 | 12.71 |
| Changes in these lamps after 24,000 hrs. of operation: | | | | | | | |
| $\Delta V_1$ | | 5.5 volt or 6.1% | | 21.0 volt or 24.3% | | | |
| $\Delta\phi_a$ | | −0.5 klm or −3.2% | | −1.34 klm or −8.9% | | | |
| 24,000 hr. maintenance | | 96.8% | | 91.1% | | | |

A significant performance gain was observed with the $Al_2O_3$ coated arc tube. The relative voltage stability is improved by a factor of 4 and the relative maintenance by a factor of about 3. The light output of the $Al_2O_3$ coated arc tube lamp at 24,060 hours is 8.9% better than the uncoated lamp. Lamp voltage $V_1$ is directly related to the sodium D-line separation $\Delta\lambda_D$ which controls lamp efficacy, i.e. voltage stability and maintenance are related. The life test data is consistent with this relationship. Further, voltage stability and impedance stability are desirable in commercial lamps that operate on ballasts with a fixed ballast impedance. This has been reduced to practice in the lamps of this invention.

In the instant invention a specific process, novel in application, has been identified and reduced to practice. The $Al_2O_3$ coating produced on the alumina arc tubes seals defects in the wall of the arc tube without a reduction in the light transmission. Further, the sealing of arc tubes with minor defects lead to improved manufacturing yields and improved lamp maintenance compared to uncoated lamps.

HPS lamps with $Al_2O_3$ coated arc tubes have been fabricated in conjunction with control lamps. These lamps have been operated for over 24,000 hours. The lamp show an improved light output of 8.9%, a relative voltage stability improvement by a factor of 4, and relative maintenance improvements by a factor of about 3 over the control lamp.

While there has been shown and described what is at present considered the preferred embodiment of the invention, it will be obvious to those skilled in the art that various changes and modifications may be made therein without departing from the scope of the invention as defined by the appended claims.

What is claimed is:

1. A high pressure sodium arc tube comprising a polycrystalline ceramic arc tube envelope, end closures, electrodes, electrical connectors and an arc tube fill; said polycrystalline ceramic arc tube envelope having a surface, a wall, and grain boundaries on said surface;

said polycrystalline ceramic arc tube envelope having a protective oxide coating concentrated at said grain boundaries on said surface of said arc tube envelope to retard sodium migration through said arc tube envelope wall.

2. A method of applying a protective oxide coating on a polycrystalline ceramic arc tube envelope having a surface, a wall, and grain boundaries on said surface to retard sodium migration through the wall of the arc tube envelope comprising the following steps:

Step 1—applying an aqueous nitrate solution of a metal corresponding to the cation of the polycrystalline ceramic arc tube envelope to the surface of the envelope to form a polycrystalline arc tube envelope coated with said aqueous nitrate solution;

Step 2—drying the product from step 1 to form an nitrate coating on said surface of said polycrystalline ceramic arc tube envelope; and Step 3—converting said nitrate coating on said surface to an oxide to form a protective oxide coating concentrated at the grain boundaries of said surface of said envelope.

3. A high pressure sodium arc tube in accordance with claim 1 wherein said polycrystalline ceramic arc tube envelope comprises a polycrystalline alumina arc tube envelope.

4. A high pressure sodium arc tube in accordance with claim 1 wherein said protective oxide coating comprises an alumina coating.

5. A method in accordance with claim 2 wherein said ceramic comprises alumina.

6. A method in accordance with claim 2 wherein said protective oxide coating comprises an alumina coating.

7. A high pressure sodium lamp comprising an outer envelope, lamp, feedthrough stem, a support frame, a base and a high pressure sodium arc tube in accordance with claim 1.

* * * * *